US007876277B2

(12) United States Patent
Shimizu

(10) Patent No.: US 7,876,277 B2
(45) Date of Patent: Jan. 25, 2011

(54) ADJUSTABLE ANTENNA COIL

(75) Inventor: Yuichi Shimizu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 300 days.

(21) Appl. No.: 12/136,521

(22) Filed: Jun. 10, 2008

(65) Prior Publication Data

US 2009/0051612 A1 Feb. 26, 2009

(30) Foreign Application Priority Data

Aug. 20, 2007 (JP) ..... 2007-213546

(51) Int. Cl.
*H01Q 9/14* (2006.01)
*H01Q 7/00* (2006.01)

(52) U.S. Cl. ..... 343/748; 343/741

(58) Field of Classification Search ..... 343/748, 343/741

See application file for complete search history.

(56) References Cited

U.S. PATENT DOCUMENTS 4,749,963 A * 6/1988 Makimoto et al. ..... 331/99

FOREIGN PATENT DOCUMENTS

JP 2003-224415 * 8/2003

* cited by examiner

*Primary Examiner*—Jacob Y Choi
*Assistant Examiner*—Darleen J Stockley
(74) *Attorney, Agent, or Firm*—Beyer Law Group LLP

(57) ABSTRACT

An antenna coil formed on a substrate surface of an insulating substrate has conductor lines forming four sides of a basic loop shape. Furthermore, the antenna coil has corner lines at a corner portion of the loop. For example, by forming trimming lines on the inner side of one of the corner lines, it becomes possible to adjust the resonant frequency in various ways without considerably disturbing the shape of distribution of magnetic flux density generated by the antenna coil as a whole.

10 Claims, 9 Drawing Sheets

ADJUSTABLE ANTENNA COIL

CLAIM OF PRIORITY

This application claims benefit of the Japanese Patent Application No. 2007-213546 filed on Aug. 20, 2007, which is hereby incorporated by reference.

BACKGROUND OF THE INVENTION

1. Field of the Invention

The present invention relates to an antenna coil having such a structure that the resonant frequency thereof can be adjusted, which is used, for example, in an RFID (Radio Frequency Identification) communication device (reader/writer) that operates in the HF (High Frequency) band.

2. Description of the Related Art

According to a related art for loop antennas used for such RFID communication devices, a plurality of trimming lines for adjusting inductance, forming shortcut connections for an innermost loop of an antenna coil, is provided, and the resonant frequency is adjusted by cutting the trimming lines one by one as appropriate.

According to the related art described above, particularly, by forming a branched line extending with a considerable length from one side of the loop toward the inner side of the loop, and arranging a large number of trimming lines in parallel at substantially rectangular intervals in the lengthwise direction of the branch line, ladder-like trimming lines projecting considerably toward the inner side of the loop are formed. Furthermore, according to the related art, it is possible to form the branch line at a slant angle with respect to one side of the loop so that the trimming lines have a trapezoidal structure, whereby the amount of change in line length (the amount of change in inductance) that occurs by cutting each of the trimming lines becomes constant. Therefore, according to the related art, it is possible to adjust the resonant frequency of the antenna coil step by step by cutting the trimming lines one by one.

According to the related art, however, since a large number of trimming lines projects considerably toward the inner side of the loop, even after cutting of the trimming lines, as well as before cutting of the trimming lines, the basic shape of the loop is distorted. Thus, the shape of distribution of magnetic fields generated from the antenna during communication is distorted by the trimming lines and the branch line, so that communication performance is degraded. Particularly, if a region where the magnetic flux density is higher than or equal to a certain level is considerably deviated from that in the basic shape, a sufficient magnetic field is not generated for an antenna at the other end of communication, so that communication might fail.

Furthermore, although the antenna structure according to the related art is suitable for adjusting the resonant frequency step by step (at a regular pitch) by cutting trimming lines one by one, in order to adjust the resonant frequency by a large amount, it is necessary to cut a large number of trimming lines, which makes the adjustment task laborious. Particularly, with the structure according to the related art, it is not possible to adjust the resonant frequency by first roughly adjusting the resonant frequency and then changing the inductance in small steps to adjust the resonant frequency to a target value. Thus, the antenna coil according to the related art is not suitable for the task of adjusting the resonant frequency using various methods of adjustment.

SUMMARY OF THE INVENTION

The present invention provides an antenna coil having a loop-shaped conduction path with at least four sides as a basic shape, in which trimming lines are formed on the inner side along one or more corner portions of the conduction path forming the basic shape.

More specifically, the antenna coil according to the present invention has a basic shape formed of a loop-shaped conduction path with first to fourth conductor lines forming four sides. Of the first to fourth conductor lines, the first and third conductor lines extend in one direction along a predetermined substrate surface with a gap therebetween, thereby forming a first pair. Similarly, the second and fourth conductor lines extend along the substrate surface in the direction crossing the first and third conductor lines with a gap therebetween, thereby forming a second pair. One end of the first conductor line and one end of the second conductor line, the other end of the second conductor line and one end of the third conductor line, and the other end of the third conductor line and one end of the fourth conductor line are connected via a corner portion, whereby the conduction path is formed.

Furthermore, the trimming lines, interconnecting adjacent two lines via one of the corner portions on the conduction path, are formed on the inner side of the conduction path along the corner portion. Thus, the trimming lines are arranged on the inner side of the corner portion, and do not considerably project to the inner side from one side of the loop forming the basic shape or is not connected to a line branched from one side of the loop.

Usually, in the case where the basic shape of an antenna coil is formed of a loop-shaped conduction path having four sides, magnetic flux generated by currents flowing on the individual sides are concentrated in a central region of the loop, so that the basic shape of distribution of magnetic flux density (dome shape) is obtained. Furthermore, when trimming lines are added to the conduction path having the basic shape, if the trimming lines are provided in such a region that the shape of the loop is considerably distorted as in the related art, the distribution of magnetic field intensity is disturbed, so that communication performance is degraded.

In view of the problem described above, the inventor of the present invention paid particular consideration to a corner potion interconnecting adjacent two sides on a conduction path, and came up with an arrangement where trimming lines are formed on the inner side of the corner portion along the conduction path. Accordingly, it is possible to adjust the resonant frequency without disturbing the magnetic flux density distribution of the basic shape, and also to change the resonant frequency using various methods.

That is, with a loop-shaped conduction path defined by four sides, since the effect of magnetic flux generated at corner portions thereof on the distribution of magnetic flux density distribution is small from the beginning, even if trimming lines are arranged at one or more corner portions, the distribution of magnetic flux density generated by the antenna coil as a whole is not distorted considerably. Thus, it is possible to adjust the resonant frequency favorably without degrading communication performance of the antenna coil both before and after cutting of the trimming lines.

Furthermore, since the trimming lines are arranged so as to bridge adjacent two sides via a corner portion, the line lengths of trimming lines increase as the trimming lines become closer to the center of the loop, and the line lengths of trimming lines decrease as the trimming lines become remoter from the center of the loop. Thus, it is possible to form a plurality of trimming lines with different line lengths at the same corner portion. Accordingly, it is possible to adjust the resonant frequency in somewhat large steps or conversely in small steps. For example, when it is desired to adjust the resonant frequency by a large amount, a trimming line closer to the center (having a relatively long line length) is cut. Then, when it is desired to change the resonant frequency by a small amount so that the resonant frequency becomes close to a target value, a trimming line remoter from the center (having a relatively short line length) is cut. As described above, various methods of adjustment can be used.

In the present invention, each trimming line is preferably formed linearly so as to connect two adjacent lines on the conduction path with one side. In this case, design and manufacturing for providing trimming lines on the substrate surface become easier, so that the efficiency of production of antenna coils can be improved.

In the present invention, alternatively, each trimming line may have a curved shape that is convex toward the outer side of the conduction path. In this case, change in the density of magnetic flux generated from the antenna coil can be suppressed, so that more favorable communication performance can be achieved.

Furthermore, from the viewpoint of avoiding substantial effect on change in the distribution of magnetic flux density as described above, according to the present invention, the following structures may be employed.

(1) The trimming lines are formed outside an imaginary rectangle formed by connecting midpoints of individual sides of the conduction path on the substrate surface.

(2) The trimming lines are formed outside an imaginary ellipse inscribed within the first to fourth conductor lines on the substrate surface.

The structure (1) defines a limit (boundary) of arranging a trimming line as close as possible to the center of the loop. That is, unless a trimming line is formed closer than the limit to the center, the distribution (peak position) of magnetic flux density generated by the antenna coil as a whole is not disturbed considerably.

The structure (2) defines a more ideal position of a trimming line. If a trimming line is formed outside the ellipse (boundary), change in the distribution of magnetic flux density generated by the antenna coil as a whole can be minimized.

According to the present invention, a plurality of trimming lines may be formed at a plurality of corner portions. In this case, by forming trimming lines at a plurality of corner portions, the resonant frequency can be adjusted in a wider range. Furthermore, when the loop has multiple (two or more) turns, trimming lines may be formed both at a corner portion of an outer turn and a corner portion of an inner turn.

With the antenna coil according to the present invention, since the shape of distribution of magnetic flux density generated as a whole is not disturbed considerably, a magnetic field is generated at an appropriate region of an antenna coil at the other end of RFID communication (reader/writer, IC card, cellular phone, or the like). Furthermore, by allowing the resonant frequency to be adjusted in multiple step sizes, it is possible to adjust the resonant frequency by a large amount by a reduced task, or to first perform rough adjustment and then perform adjustment in small steps so that the resonant frequency is adjusted to a desired value.

DESCRIPTION OF THE PREFERRED EMBODIMENTS

Now, embodiments of the present invention will be described with reference to the drawings.

Figure 1A:
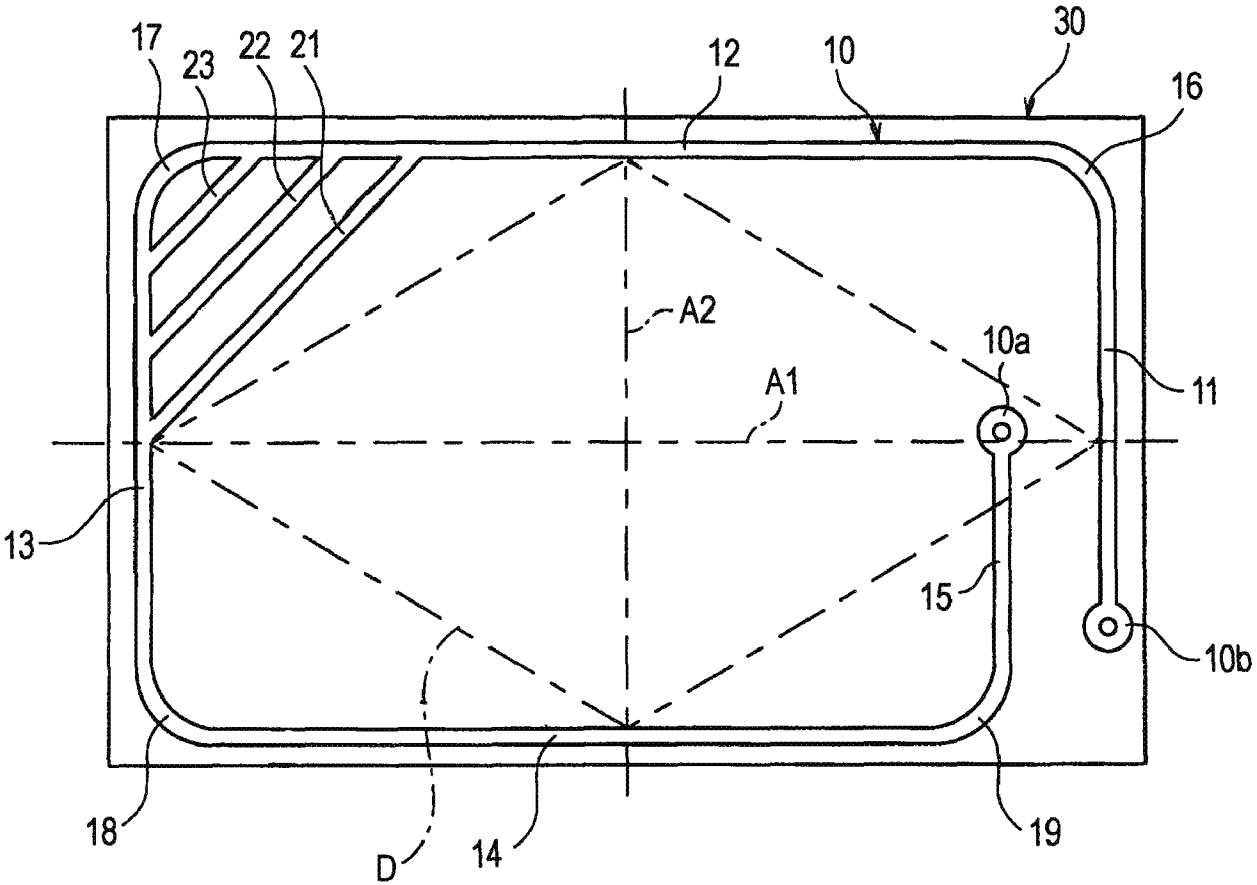
FIG. 1A is a plan view schematically showing an antenna coil according to a first embodiment.

FIG. 1A is a plan view schematically showing an antenna coil 10 according to a first embodiment, which is used, for example, in an RFID reader/writer. For example, the antenna coil 10 according to this embodiment is formed as a circuit pattern on a surface of an insulating substrate 30 (substrate surface) composed of a synthetic resin. For example, the antenna coil 10 has a basically polygonal (rectangular) loop shape (or spiral shape), and connection lands 10*a* and 10*b* are formed at its ends thereof (inner end and outer end). On the substrate surface of the insulating substrate 30, electrical circuits (not shown) are formed, and the antenna coil 10 is connected to the electrical circuits via the connection lands 10*a* and 10*b*. Furthermore, on the substrate surface of the insulating substrate 30, electronic components (not shown), such as a chip capacitor and an oscillator (AC power supply), are mounted, and the electronic components are also connected to the antenna coil 10.

As described above, the antenna coil 10 is formed of a single circuit pattern. However, the antenna coil 10 can be considered as composed of some constituting sections. For example, four sides of the polygon and corner portions each interconnecting two adjacent sides can be considered as the constituting sections.

Conductor Lines

The antenna coil 10 has linear conductor lines 11 to 14 on the four sides forming the basic shape thereof. Of the conductor lines 11 to 14, the two conductor lines 11 and 13 extend in a vertical direction on the substrate surface of the insulating substrate 30 along the right and left edges thereof. The conductor lines 11 and 13 are formed in parallel with a gap therebetween, and form a pair on the substrate surface in the width direction. The other two conductor lines 12 and 14 extend in the width direction on the substrate surface along the upper and lower edges thereof. The conductor lines 12 and 14 are also formed in parallel with a gap therebetween, and form a pair in the vertical direction on the substrate surface. The connection land 10*b* at the outer end of the antenna coil 10 is connected to the conductor line 11, located at the right edge of the insulating substrate 30. Furthermore, in this embodiment, another conductor line 15 is formed on an inner side of the conductor line 11, and the conductor line 15 is connected to the connection land 10*a* at the inner end of the antenna coil 10.

Corner Lines

Furthermore, the antenna coil 10 has corner lines 16 to 19 at the four corner portions of the polygon forming the basic shape thereof. Each of the corner lines 16 to 19 is a circuit pattern forming a curve (quarter circle). Each of the corner lines 16 to 19 is located between two adjacent sides of the polygon and interconnect the two sides. The corner line 16, located at the upper right corner in FIG. 1A, interconnects one end of the conductor line 11 and one end of the conductor line 12. The corner line 17, located at the upper left corner in FIG. 1A, interconnects the other end of the conductor line 12 and one end of the conductor line 13. The corner line 18, located at the lower left corner in FIG. 1A, interconnects the other end of the conductor line 13 and one end of the conductor line 14. The corner line 19, located at the lower right corner in FIG. 1A, interconnects the other end of the conductor line 14 and one end of the conductor line 15.

Trimming Lines

Furthermore, the antenna coil 10 has, for example, three trimming lines 21 to 23. For example, the three trimming lines 21 to 23 are formed as circuit patterns located on the inner side of the loop than the corner line 17, located at the top left corner in FIG. 1A, and forming shortcut connections between the two conductor lines 12 and 13. Furthermore, the trimming lines 21 to 23 are formed linearly, for example, at an angle of 45 degrees with respect to the conductor lines 12 and 13. Although the trimming lines 21 to 23 are located in parallel substantially at regular intervals in this embodiment, the intervals may be irregular, and the angles may be varied individually within such a range that the trimming lines 21 to 23 do not cross each other.

Of the three trimming lines 21 to 23, the trimming line 21, closest to the center of the loop, has a longest line length. Conversely, the trimming line 23, remotest from the center of the loop, has a shortest line length among the three. The other trimming line 22 has an intermediate line length among the three. Thus, the three trimming lines 21 to 23 have inductances that become larger in increasing order of their line lengths. For example, letting the inductances of the trimming lines 21, 22, and 23 be denoted as L1, L2, and L3, respectively, the relationship can be expressed as expression (1) below:

$$L1>L2>L3 \tag{1}$$

Of the antenna coil 10, the combined inductance of the trimming lines 21 to 23 can be expressed as expression (2) below:

$$LT=1/(1/L1+1/L2+1/L3) \tag{2}$$

Furthermore, as is known, the resonant frequency fr of the antenna coil 10 can be expressed as expression (3) below:

$$fr=1/(2\pi\sqrt{(L\cdot C)}) \tag{3}$$

where C denotes the capacitance of the chip capacitor, and L denotes the total inductance of the antenna coil 10 (L>LT).

Adjustment of the Resonant Frequency

According to what has been described above, in the antenna coil 10 according to this embodiment, it is possible to adjust the resonant frequency greatly by cutting the trimming line 21, which has a longer line length, than by cutting the other trimming lines 22 and 23, which have shorter line lengths. Conversely, it is possible to adjust the resonant frequency delicately by cutting the trimming line 23, which has a shorter line length, than by cutting the other trimming lines 21 and 22.

Furthermore, in the antenna coil 10 according to this embodiment, it is possible to adjust the resonant frequency in multiple steps by cutting the trimming lines 21 to 23 in combination. For example, it is possible to adjust the resonant frequency by first cutting the trimming line 21, having the longest line length, to roughly adjust the resonant frequency, and then selectively cutting the other trimming lines 22 and 23 so that the resonant frequency becomes close to a desired resonant frequency (e.g., about 13.5 MHz). Although the three trimming lines 21 to 23 are used in this embodiment as an example, four or more trimming lines may be used. In that case, it is possible to adjust the resonant frequency more flexibly.

Optimal Location of Trimming Lines

A rhombus D indicated by a single-dotted line in FIG. 1A is an imaginary rectangle formed by connecting midpoints of the sides of the polygon forming the basic shape of the antenna coil 10. In this embodiment, it is necessary that all the trimming lines 21 to 23 are located outside the rhombus D. The inventor of the present invention has verified through experiments that it is not preferable to form trimming lines inside the rhombus D (nearer to the center) since the trimming lines could disturb the magnetic flux density distribution of the antenna coil 10.

Figure 1B:
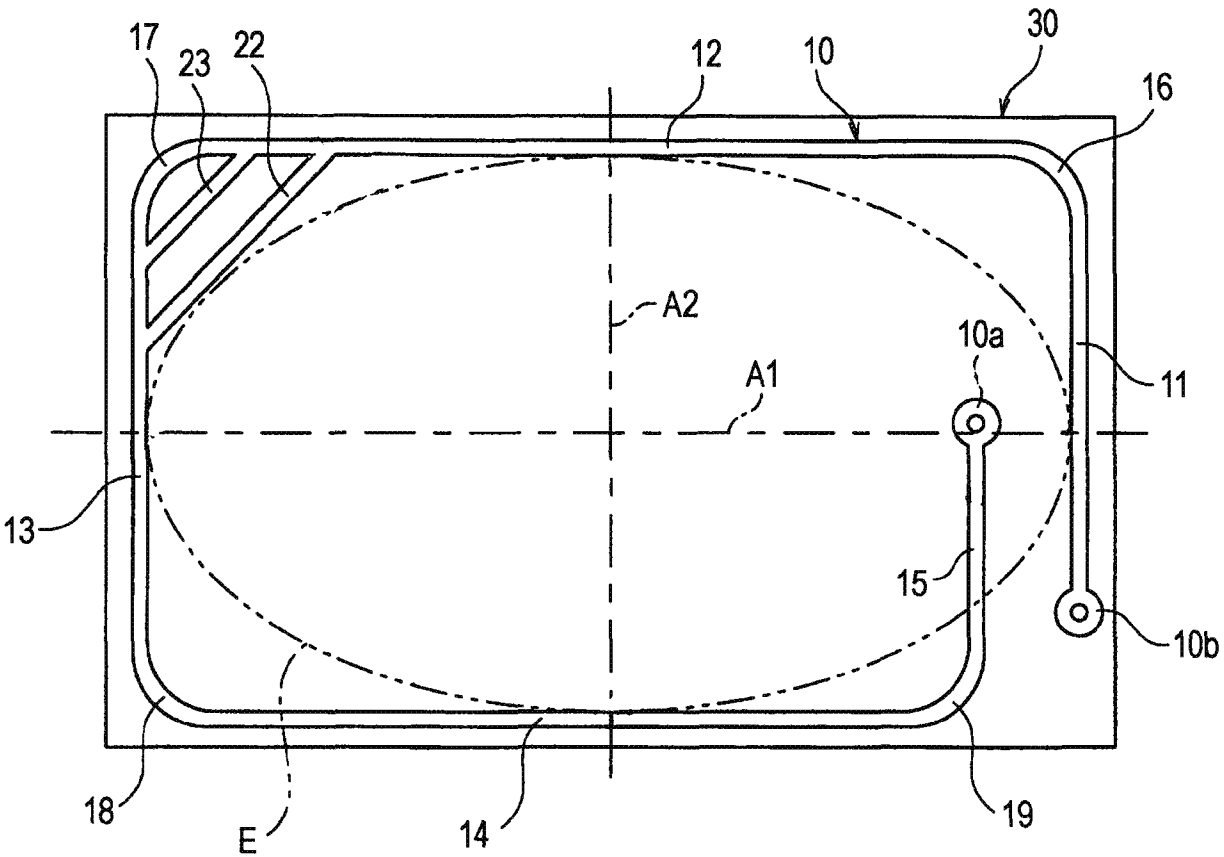
FIG. 1B is a plan view schematically showing an antenna coil according to a second embodiment.

Furthermore, an ellipse E indicated by a double-dotted line in FIG. 1B is an imaginary ellipse inscribed within the polygon forming the basic shape of the antenna coil 10 in accordance with the second embodiment. The ellipse E shown in FIG. 1B has a long axis A1 and a short axis A2 each passing through the midpoints of opposite sides. The long axis A1 is perpendicular to the conductor lines 11 and 13, and the short axis A2 is perpendicular to the conductor lines 12 and 14. The inventor of the present invention proposes that the optimal location of trimming lines is the outside of the ellipse E. That is, by forming trimming lines outside the ellipse E, as shown in FIG. 1B, change in the magnetic flux density distribution of the antenna coil 10 as a whole can be minimized. However, even if the trimming line 21 is formed inside the ellipse E as in the first embodiment, as long as the trimming line 21 is located outside the rhombus D as shown in FIG. 1A, the trimming line 21 does not significantly disturb the magnetic flux density distribution of the antenna coil 10 as a whole.

Figure 2A:
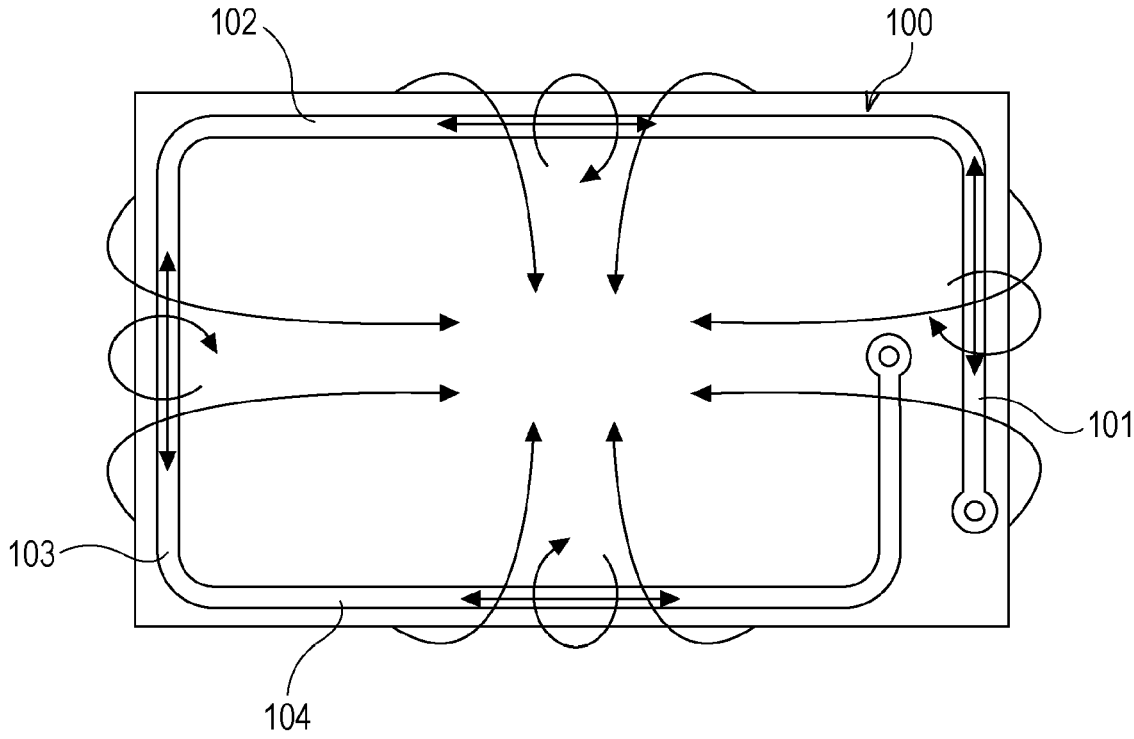
FIGS. 2A and 2B are diagrams showing relationship between magnetic fields generated by antenna coils according to a basic shape and the first embodiment.
Figure 2B:
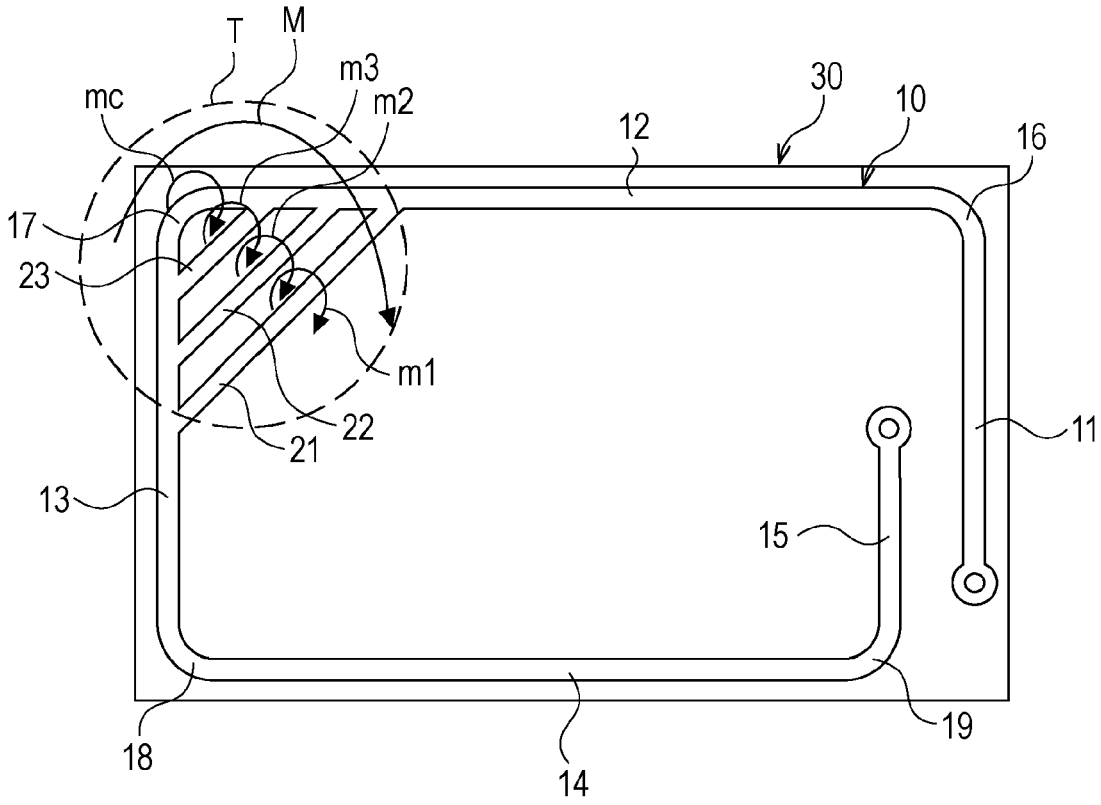

Relationship Between Location of Trimming Lines and Magnetic Flux Density Distribution Now, the relationship between the location of trimming lines and magnetic flux density distribution, described above, will be demonstrated specifically through comparison among the embodiment, the basic shape, and a comparative example. FIGS. 2A and 2B show relationship between magnetic fields generated by antenna coils according to the basic shape and the embodiment.

FIG. 2A shows an antenna coil 100 having a basic polygonal shape, in which no trimming lines are particularly formed.

In this case, when an electric power is applied to the antenna coil 100, magnetic fields generated around conduction lines are concentrated in a central region of the loop, and the magnetic fields are combined to form a favorable shape of magnetic flux density distribution (e.g., a dome shape with a top located at the center of the loop). At this time, magnetic fields generated on four sides 101 to 104 in the loop (magnetic fields indicated by arrows in FIG. 2A) mainly contribute to the shape of magnetic flux density distribution, and four corner portions do not considerably contribute to the shape of magnetic flux density distribution.

FIG. 2B shows a case where the antenna coil 10 according to the embodiment is used. Similarly to the case of the basic shape described above, magnetic fields that are generated when an electric power is applied are concentrated in a central region of the loop, and the magnetic fields are combined to form a favorable shape of magnetic flux density distribution. At this time, since the trimming lines 21 to 23 are formed at a corner portion in the embodiment, a combined magnetic field M is generated in a region T indicated by a broken line in FIG. 2B. The combined magnetic field M is a combination of individual magnetic fields m1 to m3 generated by the trimming lines 21 to 23 and a magnetic field mc generated by the corner line 17.

As described above, it is understood that, in the antenna coil 100 having the basic shape, mainly the magnetic fields generated on the four sides 101 to 104 contribute to the shape of magnetic flux density distribution as a whole, and the magnetic fields generated at the corner portions do not considerably affect the shape of magnetic flux density distribution. Furthermore, in the antenna coil 10 according to the embodiment, the trimming lines 21 to 23 are added at a corner portion of the antenna coil having the basic shape, so that the combined magnetic field M generated in the region T in the proximity of the corner portion does not substantially interfere with formation of magnetic fields in the antenna coil 10 as a whole.

Comparative Example

Figure 3:
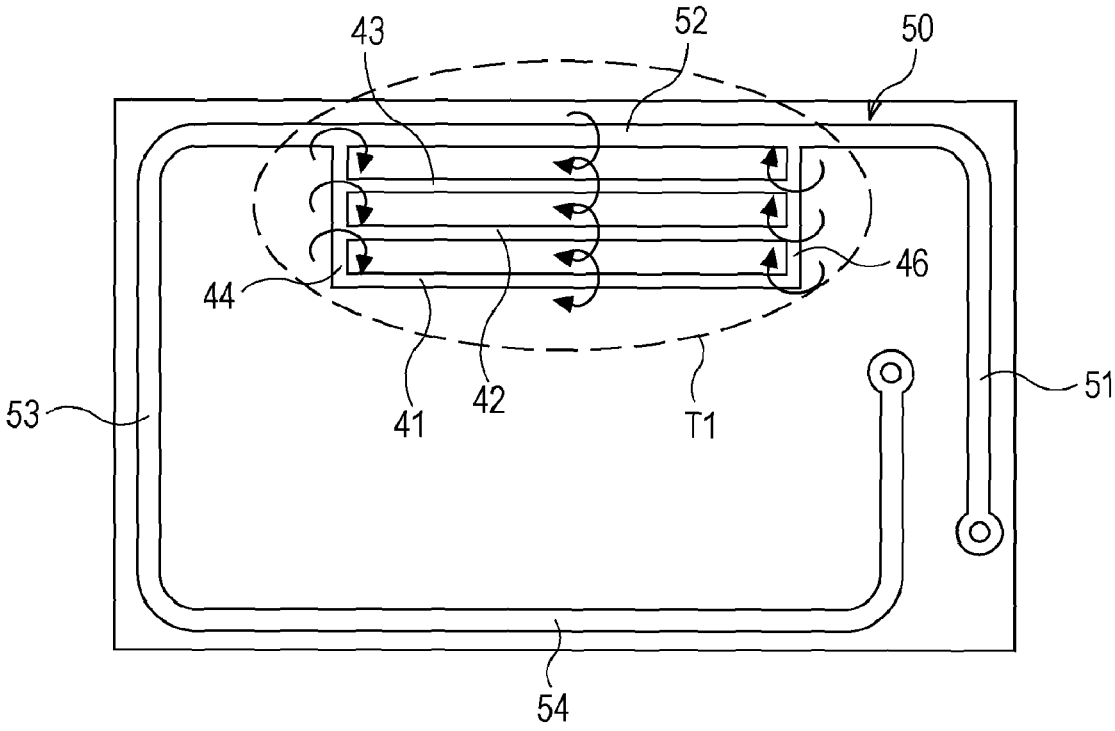
FIG. 3 is a diagram showing a magnetic field generated by an antenna coil according to a comparative example.

FIG. 3 shows a magnetic field generated in an antenna coil 50 according to a comparative example. First, the structure of the antenna coil 50 according to the comparative example will be described. The antenna coil 50 according to the comparative example also has a basic shape forming a polygonal loop. Furthermore, in the antenna coil 50 according to the comparative example, two branch lines 44 and 46 branch from a long side 52, and the branch lines 44 and 46 are considerably separated in the lengthwise direction of the long side 52 and extend perpendicularly to the long side 52 toward the inner side of the loop. Furthermore, in the antenna coil 50 according to the comparative example, three trimming lines 41 to 43 are formed so as to bridge the two branch lines 44 and 46.

In the antenna coil according to the comparative example described above, the trimming lines 41 to 43 and the branch line 44 and 46 are formed so as to project considerably toward the inner side of the loop. In this case, magnetic fields generated in a region T including the trimming lines 41 to 43 and the branch lines 44 and 46 interfere each other, so that the shape of magnetic flux density distribution of the antenna coil 50 as a whole is considerably disturbed. Particularly, in the comparative example, the magnetic field generated on the long side 52 is disturbed, so that the magnetic field generated on the long side 52 does not favorably contribute to the shape of magnetic flux density distribution as a whole.

Verification Through Measurement of Magnetic Field Intensity

Figure 4A:
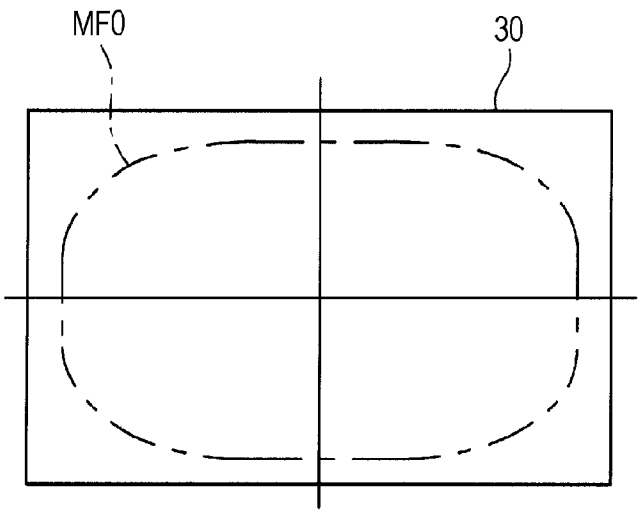
FIGS. 4A to 4D are schematic diagrams showing distributions of magnetic field intensity according to the basic shape and the first embodiment.

Now, a comparison between the basic shape and the embodiment, and a comparison with the comparative example, will be examined specifically based on results of measurement of magnetic field intensity. FIGS. 4A to 4D are schematic diagrams showing the distribution of intensities (magnetic flux densities) of magnetic fields generated by antenna coils according to the basic shape and the embodiment. FIGS. 5A and 5B are schematic diagrams showing the distribution of magnetic field intensity in the comparative example. In FIGS. 4A, 4C, and 5A, antenna coils are not shown.

Basic Shape

FIG. 4A shows a boundary MF0 of a magnetic field generated on the substrate surface of the insulating substrate 30 in relation to the antenna coil 100 having the basic shape. A magnetic field (magnetic flux) having a level effective for RFID communication is generated mainly within the boundary MF0, and the magnetic field intensity is weak outside the boundary MF0. In this case, the boundary MF0 of the distribution region forms a favorable shape along the loop shape of the antenna coil 100.

Figure 4B:
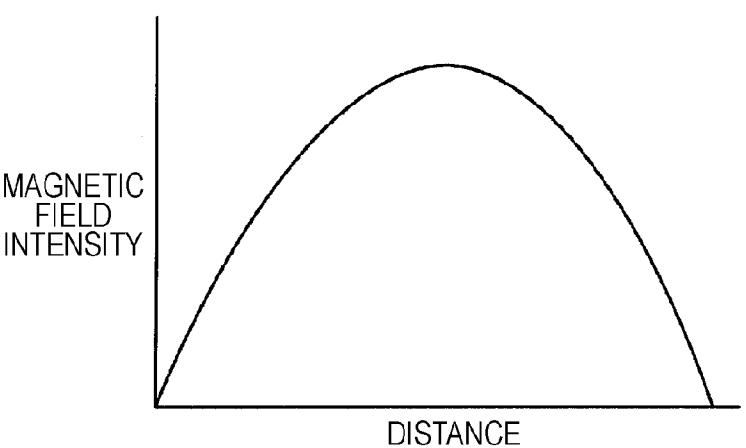
Figure 4C:
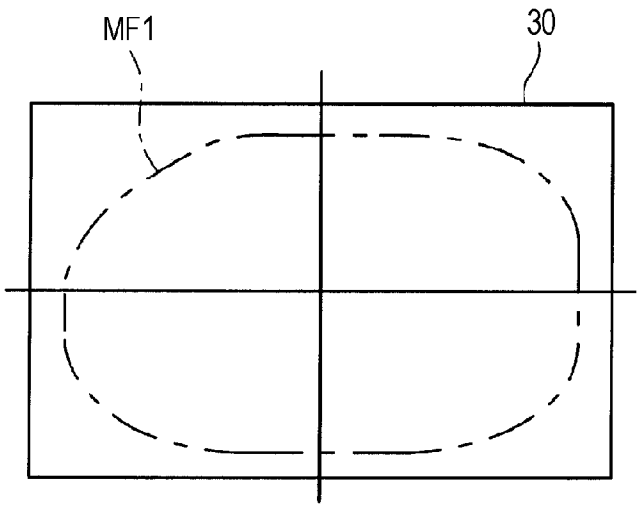
Figure 5A:
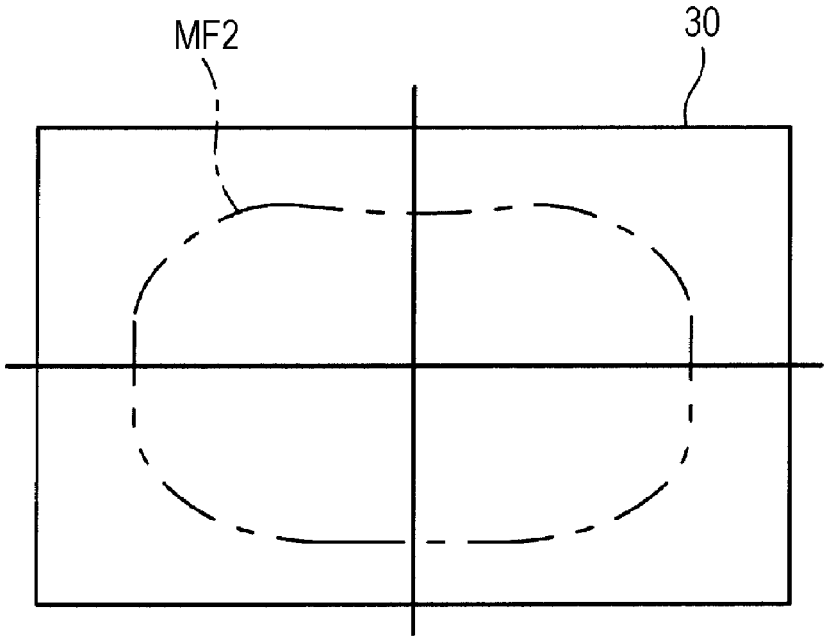
FIGS. 5A and 5B are schematic diagrams showing the distribution of magnetic field intensity according to the comparative example.
Figure 5B:
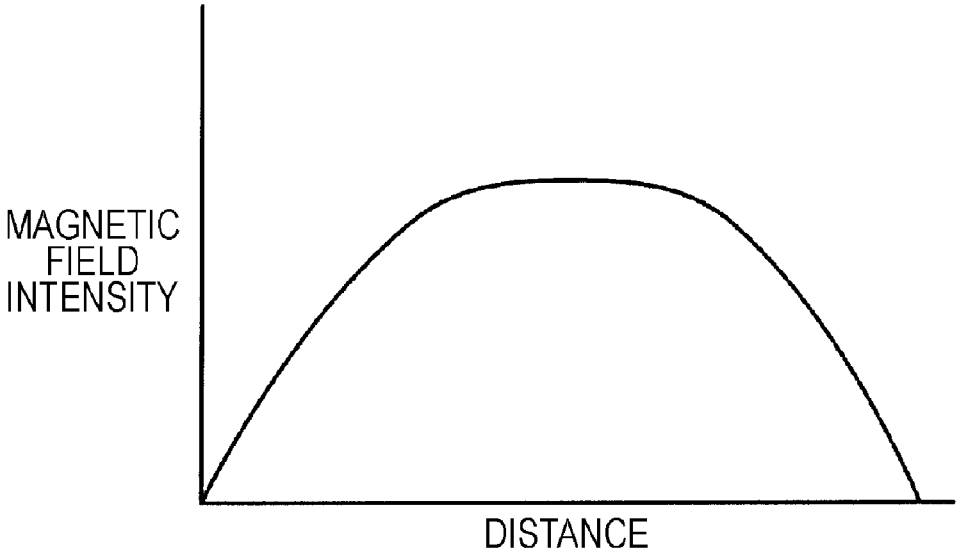

FIG. 4B shows the distribution of magnetic field intensity (magnetic flux density) viewed in the lengthwise direction on the substrate surface of the insulating substrate 30 regarding the antenna coil 100 having the basic shape. In this case, the magnetic field intensity exhibits a basic shape of distribution, in which the magnetic field intensity has a peak at the center of the loop, and the magnetic field intensity becomes lower as the distance from the center increases.

Embodiment

FIG. 4C similarly shows a boundary MF1 of a magnetic field generated on the substrate surface of the insulating substrate 30 in relation to the antenna coil 10 according to the embodiment. In the case of the embodiment, although the boundary MF1 of the distribution region is slightly deformed inward (reduced) in the region where the trimming lines 21 to 23 are formed, otherwise the boundary MF1 exhibits a favorable shape along the loop shape of the antenna coil 10. It is understood that the antenna coil 10 as a whole has a magnetic flux density distribution substantially the same as that in the case of the basic shape.

Figure 4D:
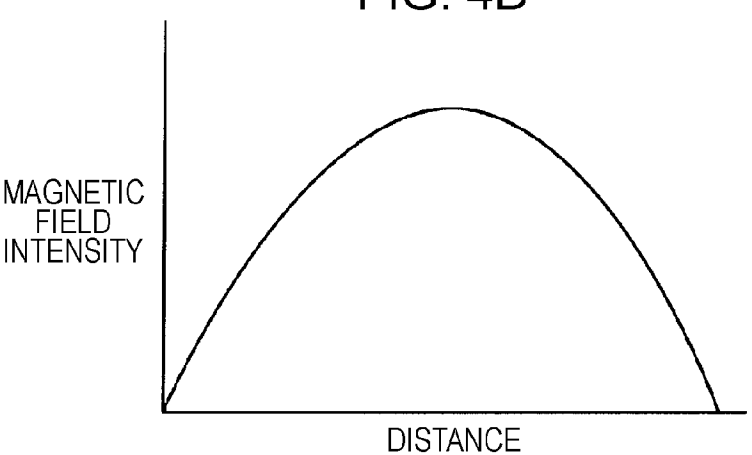

FIG. 4D shows the distribution of magnetic field intensity (magnetic flux density) viewed in the lengthwise direction on the substrate surface of the insulating substrate 30 regarding the antenna coil 10 according to the embodiment. In the case of the embodiment, the peak value of the magnetic field intensity is slightly smaller than that in the case of the basic shape, and the shape of the magnetic field intensity distribution is similar to that in the case of the basic shape.

Comparative example

FIG. 5A shows a boundary MF2 of a magnetic field generated on the substrate surface of the insulating substrate 30 in relation to the antenna coil 50 according to the comparative example. In the comparative example, the boundary MF2 of the distribution region is considerably deformed toward the inner side (reduced) in the region where the trimming lines 41 to 43 are formed. Furthermore, regarding the antenna coil 50 as a whole, the boundary MF2 is reduced toward the inner side compared with the basic shape or the embodiment, so that it is understood that the region of distribution of magnetic field intensity (magnetic flux density) is narrower accordingly. This can be considered as a result of the disturbance of magnetic field in the proximity of the trimming lines 41 to 43, which interferes with formation of magnetic fields by the antenna coil 50 as a whole.

FIG. 5B shows the distribution of magnetic field intensity (magnetic flux density) viewed in the lengthwise direction on the substrate surface of the insulating substrate 30 regarding the antenna coil 50 according to the comparative example. In the comparative example, the peak of the magnetic field intensity is lower than that in the basic shape or the embodiment, and the magnetic field intensity (magnetic flux density) becomes extremely low in a central region of the loop. Therefore, it is understood that, in the comparative example, the shape of distribution of magnetic field intensity (magnetic flux density) is considerably distorted compared with that in the basic shape.

Sectional Shape of the Distribution of Magnetic Field Intensity

FIG. 6 shows sectional shapes (taken along the short axis) of distribution of magnetic field intensity viewed on the substrate surface regarding the basic shape, the embodiment, and the comparative example.

Basic Shape

Figure 6A:
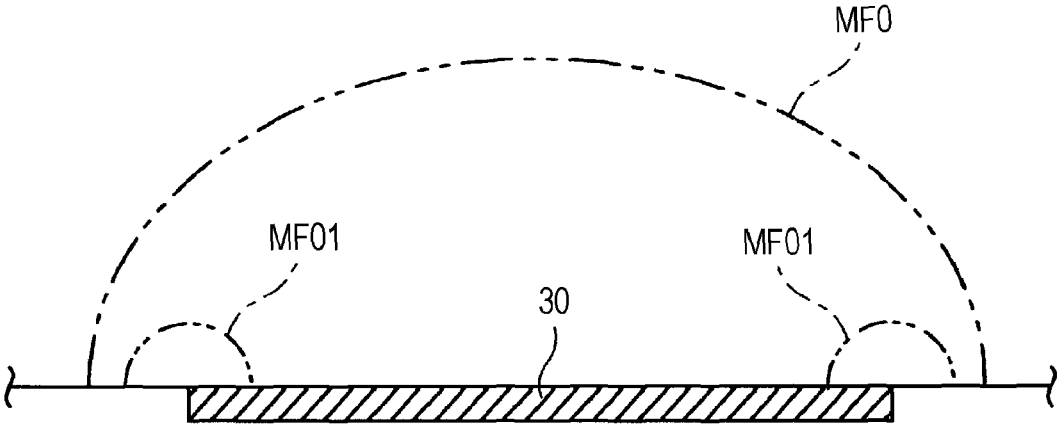
FIGS. 6A to 6C are schematic sectional diagrams showing comparison of the distribution of magnetic field intensity viewed on a substrate surface according to the basic shape, the first embodiment, and the comparative example.

Referring to FIG. 6A, in the antenna coil 100 having the basic shape, magnetic fields generated on individual sides of the loop are favorably concentrated (combined) in a central region, so that the distribution of magnetic field intensity (boundary MF0) has a favorable dome shape as a whole. In FIG. 6A, two boundaries MF01 schematically represent boundaries of local magnetic fields (before combining) generated around the two long sides 102 and 104 of the antenna coil 100.

Embodiment

Figure 6B:
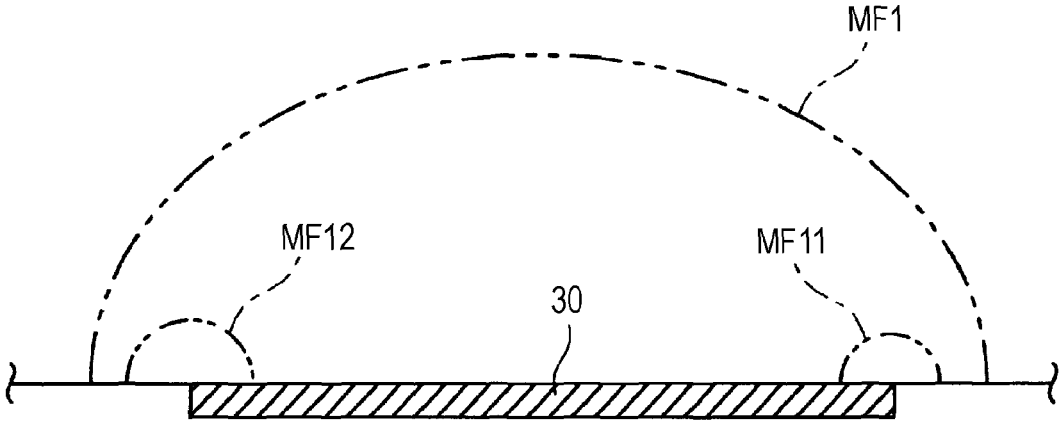

Referring to FIG. 6B, also in the antenna coil 10 according to the embodiment, similarly to the basic shape, magnetic fields generated on the individual sides (the conductor lines 11 to 14) of the loop are favorably concentrated (combined) in a central region, so that the distribution of magnetic field intensity (boundary MF1) has a favorable dome shape as a whole. In FIG. 6B, two boundaries MF11 and MF12 schematically represent boundaries of magnetic fields (before combining) generated around the conductor lines 12 and 14, respectively. In this embodiment, the local magnetic field (boundary MF11) generated around the conductor line 12 is slightly reduced due to the effect of a combined magnetic field associated with the trimming lines 21 to 23, the distribution of magnetic field intensity as a whole is not disturbed considerably.

Comparative Example

Figure 6C:
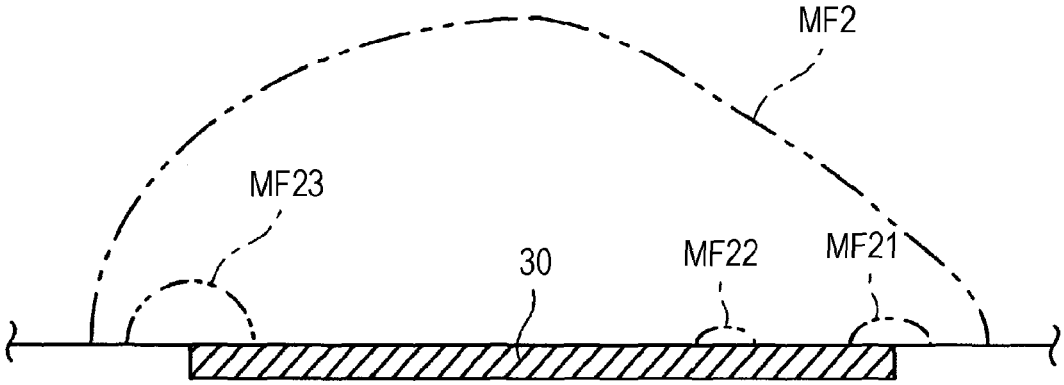

Referring to FIG. 6C, in the antenna coil 50 according to the comparative example, the distribution of magnetic field intensity (boundary MF2) as a whole is disturbed considerably. This is because the distribution of magnetic field intensity as a whole is disturbed by magnetic fields generated by the trimming lines 41 to 43 and the branch lines 44 and 46. In FIG. 6C, two boundaries MF21 and MF22 represent boundaries of local magnetic fields (before combining) generated around the long side 52 and the trimming line 41. Compared with the case of the basic shape or the embodiment, it is understood that, in the comparative example, the distribution region of the local magnetic fields is also reduced. This is because the local magnetic fields generated by the trimming lines 41 to 43 and the branch lines 44 and 46 interfere each other or cancel each other in complex ways.

Superiority of the Embodiment

As described above, in the antenna coil 10 according to the embodiment, although the trimming lines 21 to 23 are formed, the distribution of magnetic field intensity as a whole is not disturbed considerably. Thus, the antenna coil 10 can exhibit favorable communication performance comparable to that of the antenna coil 100 having the basic shape.

Other Embodiments

Figure 7:
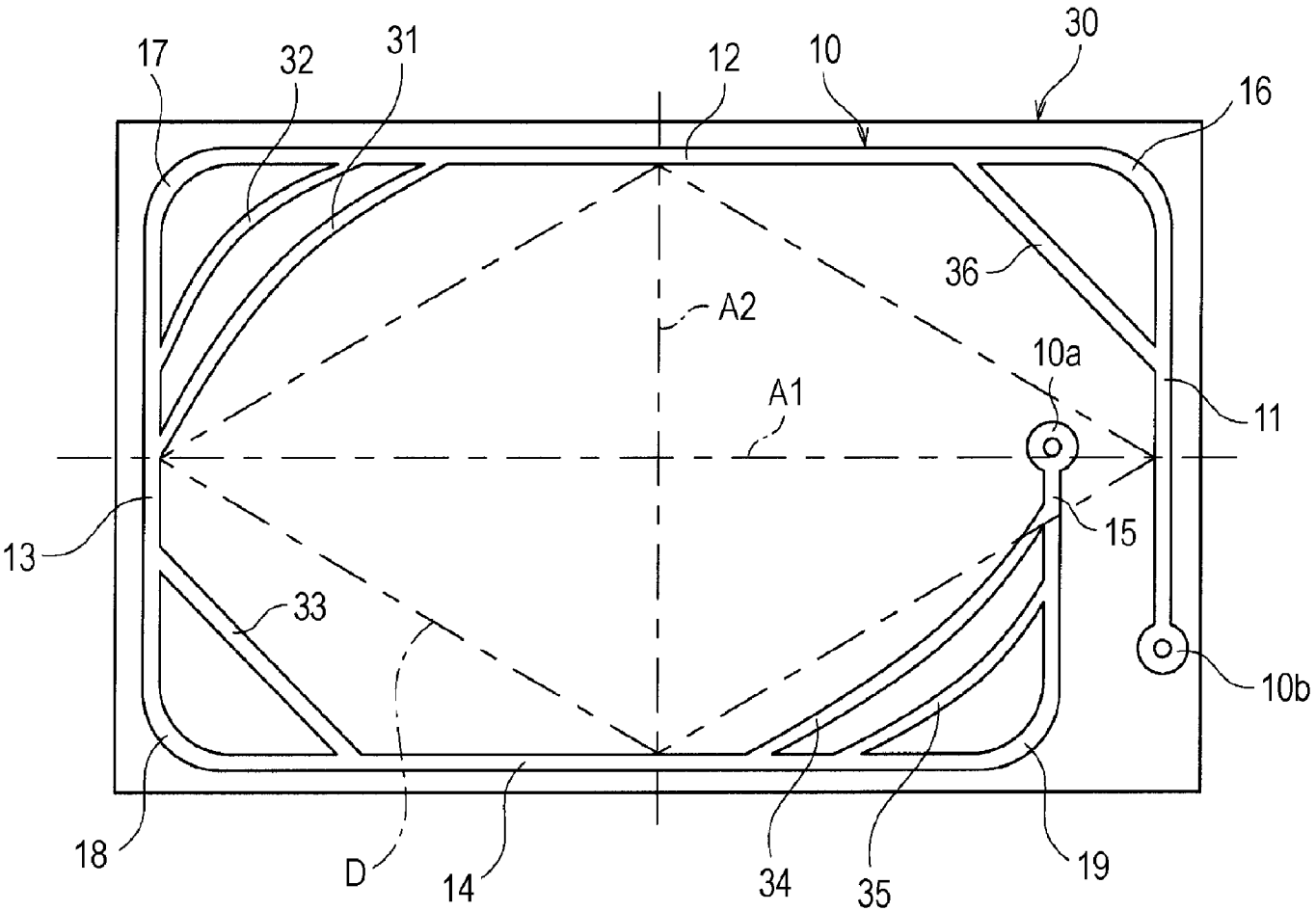
FIG. 7 is a diagram showing a second embodiment, in which trimming lines are arranged differently from the first embodiment.

FIG. 7 shows a second embodiment of the present invention, in which trimming lines are arranged differently compared with the first embodiment. In the first embodiment, trimming lines 21 to 23 are provided at a corner portion. In contrast, in the second embodiment, trimming lines 31 to 36 are formed at a plurality of corner portions.

Furthermore, in the second embodiment, the trimming lines 21 to 23 are formed linearly. In the second embodiment, curved trimming lines 31 and 32 are formed instead. Furthermore, in the second embodiment, curved trimming lines 34 and 35 are formed on the inner side of another corner line 19. Each of the curved trimming lines 31, 32, 34, and 35 has a curved shape that is convex toward the outer side of the loop. With the trimming lines 31, 32, 34, and 35 described above, it is possible to adjust the resonant frequency of the antenna coil 10 similarly to the first embodiment. Furthermore, since the distribution of magnetic flux density of the antenna coil 10 as a whole is not disturbed, it is possible to ensure favorable communication performance of the antenna coil 10.

Although not specifically shown here, the inventor of the present invention has verified that with the curved trimming lines 31, 32, 34, and 35, compared with linear trimming lines, the effect on the distribution of magnetic flux density as a whole can be reduced further.

Furthermore, by forming trimming lines 31 to 36 at a plurality of corner portions as in the second embodiment, the range of adjustment of resonant frequency can be increased accordingly. Also in the second embodiment, the trimming lines 31 to 36 are formed outside the imaginary rhombus D. With this layout, although the trimming lines 31 to 36 are provided at a plurality of corner portions, the distribution of magnetic flux density of the antenna coil 10 as a whole is not disturbed, so that the antenna coil 10 can exhibit favorable communication performance.

Figure 8:
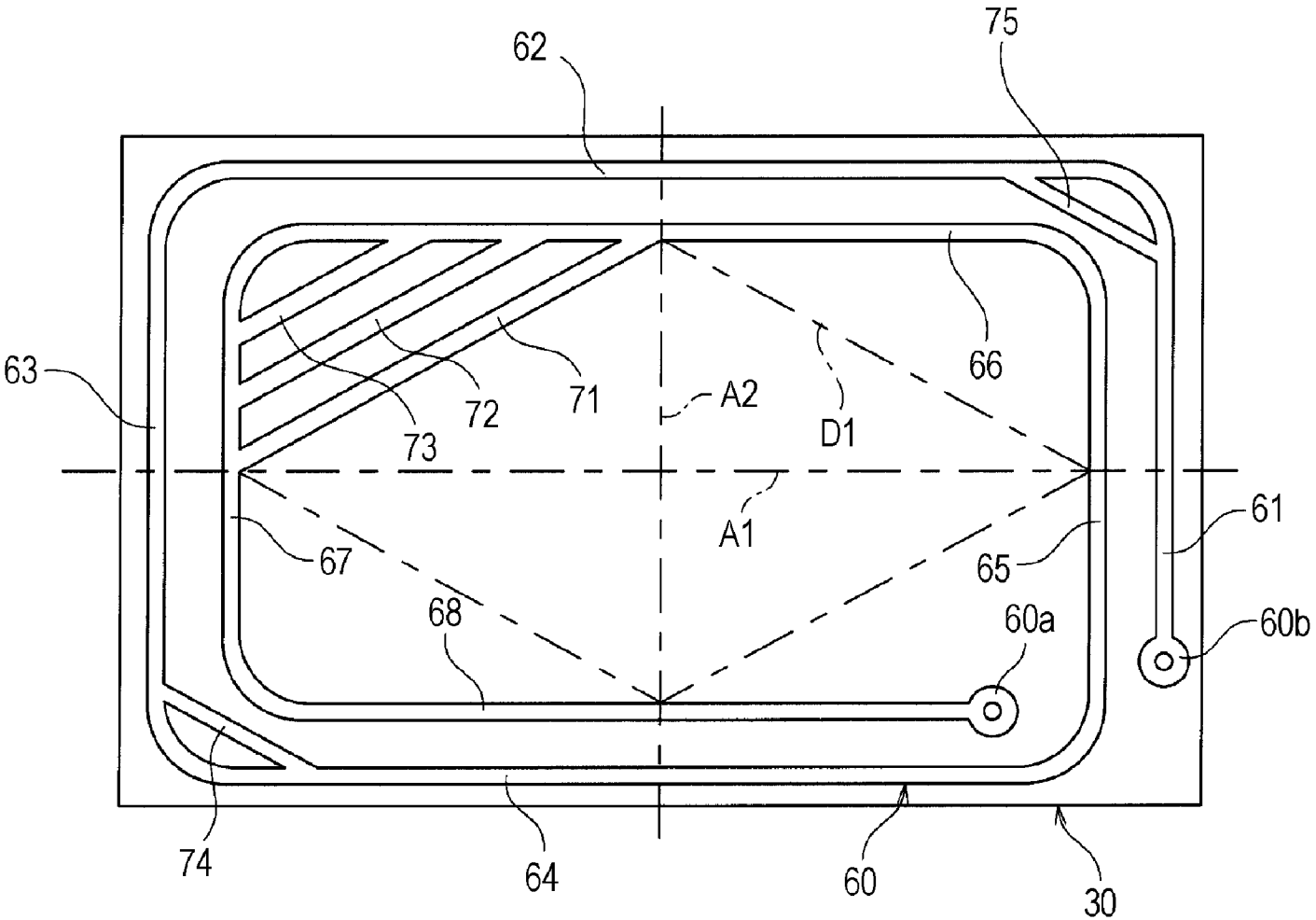
FIG. 8 is a diagram showing an antenna coil according to a third embodiment.

FIG. 8 is a diagram showing an antenna coil 60 according to a third embodiment. For example, the antenna coil 60 according to the third embodiment is formed of a two-turn loop, and has eight conductor lines 61 to 68 as sides of the loop. Connection lands 60*a* and 60*b* provided at the inner end and outer end of the antenna coil 60 are connected to the conductor lines 68 and 61 located on the inner end and outer end of the loop, respectively.

In the third embodiment, in which the antenna coil is formed of a multiple-turn (two-turn herein) loop, it is possible to form trimming lines 71 to 73 on the inner turn of the loop and to form trimming lines 74 and 75 on the outer turn of the loop. Assuming an imaginary rhombus D1 for the inner turn of the loop, the trimming lines 71 to 73 are preferably provided outside the rhombus D1.

Furthermore, in the third embodiment, the trimming lines 71 to 75 are connected to the conductor lines at an angle different from 45 degrees (e.g., at an angle of 30 degrees with respect to the horizontal conductor lines). Even at this angle, magnetic fields generated at corner portions of the loop as described earlier do not significantly affect the shape of distribution of magnetic flux density of the antenna coil 60 as a whole. Thus, also in the third embodiment, similarly to the first embodiment, the antenna coil 60 can exhibit favorable communication performance.

Furthermore, also in the third embodiment, similarly to the first embodiment, obviously, it is possible to adjust the resonant frequency of the antenna coil 60 by cutting the trimming lines 71 to 75.

The present invention is not limited to the embodiments described above, and may be embodied with various modifications. For example, although each of the embodiments relates to an antenna coils formed on a substrate surface, an antenna coil may be formed in an internal layer of a substrate. Furthermore, the antenna coil according to each of the embodiments can be used as a transponder as well as a reader/writer (interrogator) for RFID communication, or as an IC card, cellular phone, or the like carried by an individual user. Furthermore, although trimming lines have a common width in each of the embodiments described above, by varying the widths of trimming lines, it is possible to vary the step size of change in resonant frequency that occurs by cutting the individual trimming lines.

What is claimed is:

1. An adjustable antenna coil comprising:

first and third conductor lines forming a first pair, extending in a first direction along a predetermined substrate surface and formed with a gap therebetween;

second and fourth conductor lines forming a second pair, extending along the substrate surface in a direction crossing the first and third conductor lines and formed with a gap therebetween;

a plurality of corner portions interconnecting one end of the first conductor line and one end of the second conductor line, the other end of the second conductor line and one end of the third conductor line, and the other end of the third conductor line and one end of the fourth conductor line, thereby forming a conduction path having a loop shape with at least four sides; and a trimming line formed on an inner side of the conduction path along one of the plurality of corner portions so as to interconnect two sides adjacent via the one corner portion on the conduction path, wherein the trimming line is formed outside an imaginary rectangle formed by connecting midpoints of individual sides of the conduction path on the substrate surface.

2. The adjustable antenna coil according to claim 1, wherein the trimming line is formed linearly so as to interconnect the two adjacent sides with one side.

3. The adjustable antenna coil according to claim 1, wherein the trimming line has a curved shape that is convex toward an outer side of the conduction path.

4. The adjustable antenna coil according to claim 1, wherein a plurality of trimming lines are provided along the plurality of corner portions.

5. The adjustable antenna coil according to claim 1, wherein a plurality of trimming lines are provided on the inner side of the conduction path along the one corner portion.

6. An adjustable antenna coil comprising:

first and third conductor lines forming a first pair, extending in a first direction along a predetermined substrate surface and formed with a gap therebetween;

second and fourth conductor lines forming a second pair, extending along the substrate surface in a direction crossing the first and third conductor lines and formed with a gap therebetween;

a plurality of corner portions interconnecting one end of the first conductor line and one end of the second conductor line, the other end of the second conductor line and one end of the third conductor line, and the other end of the third conductor line and one end of the fourth conductor line, thereby forming a conduction path having a loop shape with at least four sides; and a trimming line formed on an inner side of the conduction path along one of the plurality of corner portions so as to interconnect two sides adjacent via the one corner portion on the conduction path, wherein the trimming line is formed outside an imaginary ellipse inscribed within the first to fourth conductor lines on the substrate surface.

7. The adjustable antenna coil according to claim 6, wherein the trimming line is formed linearly so as to interconnect the two adjacent sides with one side.

8. The adjustable antenna coil according to claim 6, wherein the trimming line has a curved shape that is convex toward an outer side of the conduction path.

9. The adjustable antenna coil according to claim 6, wherein a plurality of trimming lines are provided along the plurality of corner portions.

10. The adjustable antenna coil according to claim 6, wherein a plurality of trimming lines are provided on the inner side of the conduction path along the one corner portion.

* * * * *